United States Patent [19]

Rahbe et al.

[11] Patent Number: 4,676,886

[45] Date of Patent: Jun. 30, 1987

[54] PROCESS FOR PRODUCING ANODE GRADE COKE EMPLOYING HEAVY CRUDES CHARACTERIZED BY HIGH METAL AND SULFUR LEVELS

[75] Inventors: Georgette Rahbe, Los Teques; Roger Marzin, San Antonio de los Altos; Ivan Cavicchioli, Caracas; Julio Krasuk; Rodolfo B. Solari, both of Los Teques, all of Venezuela

[73] Assignee: Intevep, S.A., Caracas, Venezuela

[21] Appl. No.: 892,309

[22] Filed: Aug. 4, 1986

Related U.S. Application Data

[63] Continuation-in-part of Ser. No. 735,694, May 20, 1985.

[51] Int. Cl.[4] ..... C10G 31/14

[52] U.S. Cl. ..... 208/50; 208/96; 208/131; 208/71

[58] Field of Search ..... 208/48 R, 58, 83, 96, 208/59, 50, 52, 71, 86, 131

[56] References Cited

U.S. PATENT DOCUMENTS

| | | | |
|---|---|---|---|
| 2,727,853 | 12/1955 | Hennig | 208/86 |
| 3,518,182 | 6/1970 | Paterson | 208/50 |
| 3,617,481 | 11/1971 | Voorheis, Jr. et al. | 208/96 |
| 3,929,617 | 12/1975 | Henry et al. | 208/96 |
| 4,039,429 | 8/1977 | Van Klinken et al. | 208/50 X |
| 4,062,758 | 12/1977 | Goudriaan et al. | 208/86 X |
| 4,364,819 | 12/1982 | Hutchings et al. | 208/96 |

*Primary Examiner*—Andrew H. Metz
*Assistant Examiner*—Glenn Caldarola
*Attorney, Agent, or Firm*—Bachman & LaPointe

[57] ABSTRACT

The present invention is drawn to a process for the production of anode grade coke from a hydrocarbon feed characterized by high levels of sulfurs and metals. The hydrocarbon feed is hydrocracked in a hydrocracking reactor so as to produce an overhead effluent which is fed to a hot separator wherein a light hydrocarbon stream and a slurry hydrocracked product are produced. The hydrocracked product is fed to a separator and mixed with a solvent wherein the solids are separated out from the hydrocracked residual so as to produce a clean hydrocracked residual which is fed to a coking drum and coked so as to leave a mass of green anode grade coke.

8 Claims, 1 Drawing Figure

PROCESS FOR PRODUCING ANODE GRADE COKE EMPLOYING HEAVY CRUDES CHARACTERIZED BY HIGH METAL AND SULFUR LEVELS

CROSS REFERENCE TO RELATED APPLICATION

This application is a continuation-in-part of U.S. application Ser. No. 735,694, filed May 20, 1985, now allowed.

BACKGROUND OF THE INVENTION

The present invention is drawn to a process for upgrading hydrocarbon feeds characterized by high levels of sulfur and metals and, more particularly, a process for making anode grade coke for use in the production of electrodes for the aluminum industry.

Heretofore, hydrocarbon feeds characterized by high levels of sulfur and metals have not been successfully processed so as to transform the feeds into products which will produce industrial anode grade coke when subjected to a delayed coking process. Commercial specifications for anode grade calcined coke are as follows: for each metal less than 200 ppm, sulfur 0.4–3 wt.%, ash 0.1–4 wt.%., bulk density 82–92 G/100 CC, apparent density 1.65–1.78 G/CC, real density 2.04–2.07 G/CC, electrical resistivity 0.034–0.042 OHM-INCH and porosity 100–240 MM3/G. Heretofore these specifications have not been obtainable when processing hydrocarbon feeds characterized by high levels of sulfur and metals by conventional, economical processes. Conventional processing of typical refining processes of these hydrocarbon feeds results in higher operating costs and generally the production of products which are predominantly of little value and not suitable for anode grade coke.

Naturally, it is highly desirable to provide a process for upgrading feeds characterized by high levels of sulfur and metals so as to allow for the economical production of petroleum products. The process of the present invention should allow for the economic production of coke suitable for the manufacture of anodes for use in the aluminum industry.

Accordingly, it is a principal object of the present invention to provide a process for upgrading hydrocarbon feeds characterized by high levels of sulfur and metals.

It is a particular object of the present invention to provide a process for upgrading hydrocarbon feeds having high levels of sulfur and metals for use in the production of anode grade coke.

Further objects and advantages of the present invention will appear hereinbelow.

SUMMARY OF THE INVENTION

In accordance with the present invention the foregoing objects and advantages are readily obtained.

The present invention is drawn to a process for the production of anode grade coke from a hydrocarbon feed characterized by high levels of sulfur and metals. In accordance with the process of the present invention a hydrocarbon feed of the type characterized above is fed to a hydrocracking reactor and treated under the following conditions so as to produce an effluent overhead product: pressure about between 1000 to 4000 psi, LHSV of about between 0.2 to 3.0 $HR^{-1}$, continuous or semi-continuous catalyst addition, hydrogen-crude ratio of about between 3,000 to 40,000 SCF/B and temperature of about between 420° to 500° C. The overhead effluent is fed to a hot separator wherein a light hydrocarbon stream and a slurry hydrocracked product are produced. The slurry hydrocracked product is thereafter fed to a separator wherein the hydrocracked product is mixed with a solvent for separating out the solids from the hydrocracked residual product so as to produce a clean upgraded hydrocracked residual having significantly lower sulfur and metals content than that of the hydrocarbon feed. The clean hydrocracked residual is thereafter fed to coking drums wherein the feedstock decomposes leaving a mass of green coke whose chemical composition and physical properties meet the specifications of anode grade calcined coke.

The process of the present invention allows for the economic production of valuable anode grade coke for use in the production of electrodes employed in the reduction process used by the aluminum industry.

BRIEF DESCRIPTION OF THE DRAWINGS

The FIGURE is a schematic flow diagram illustrating the process of the present invention.

DETAILED DESCRIPTION

Figure 1:
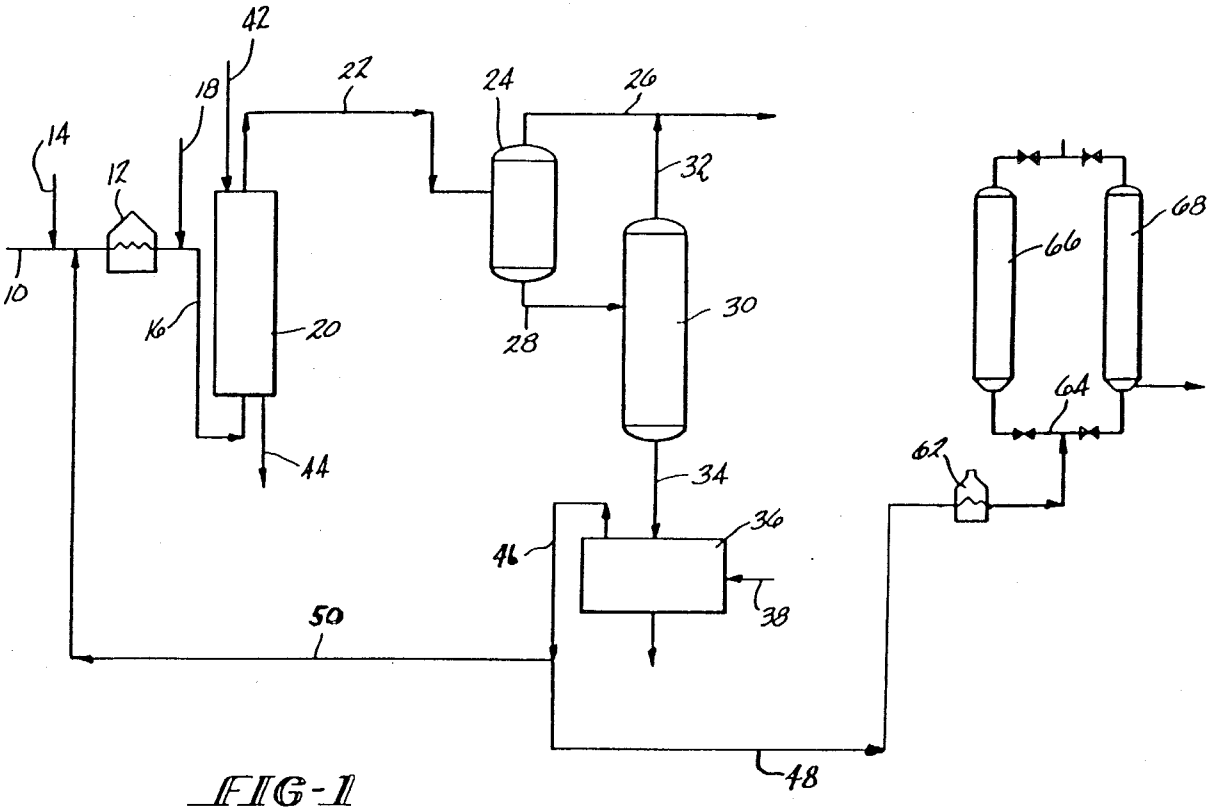

The present invention is drawn to a process for upgrading hydrocarbon feeds characterized by high levels of sulfur and metals and, more particularly, a process for making anode grade coke for use in the production of electrodes for the aluminum industry.

With reference to FIG. 1, a heavy crude or any fractional residual from the crude characterized by high levels of sulfur and metals, that is metals contents greater than 200 ppm per element and sulfur contents in excess of 3 wt.% is fed via line 10 to a preheater 12. A finely divided catalyst is mixed with the incoming crude in line 10 via line 14 prior to delivery to the preheater 12. The catalyst employed in the process of the present invention may be a low cost natural catalyst such as laterite, limonite, bauxite, clay, siderite or catalysts containing hydrogenating metals such as cobalt, molybdenum, nickel on a porous support, or said metals as such, or its metal oxides or its metal sulphides without any support, in microparticles suspended in the feed. In addition, sub-products from other processes such as coke and red mud can be used. Suitable particle size of the catalyst is from about between 0.1 μm to 1000 μm and preferably from about between 0.5 μm to 100 μm. The concentration of catalyst in the crude feed should be in the range of about between 0.1 to 10.0 wt.% with respect to the feed.

The preheat stream is removed from preheater 12 via line 16 and is mixed with hot hydrogen from line 18 prior to delivery to the hydrocracking reactor 20. The ratio of hydrogen to crude feed is about between 3000 to 40,000 SCF/B. The reactor 20 may be in the form of a bubble column type reactor, upflow slurry reactor, ebullated bed reactor or a cascade of such reactors. It should be understood that, in the case where an ebullated bed reactor is used, no catalyst is added through line 14 to the heavy crude of line 10. In this case, the catalyst is contained inside the ebullated bed reactor in fluidized state and it is periodically or continuously renewed by addition of fresh catalyst through line 42 and removal of used catalyst through line 44. This is no limitation on the range of operating conditions in the hydrocracking reactor; however, the preferred conditions are pressure about between 1000 to 4000 psi, LHSV of about between 0.2 to 3 $HR^{-1}$, hydrogen-crude ratio of about between 3,000 to 40,000 SCF/B and temperature of about between 420° to 500° C. The LHSV is defined as the ratio of the volumetric feed rate of fresh feed to the volume of the reactor.

After reaction in the hydrocracker 20, the effluents are removed via line 22 and fed to a hot separator 24 which operates at approximately the same pressure and temperature as the hydrocracker 20 so as to obtain a light hydrocarbon stream 26 and a residual hydrocracked product 28. The residual hydrocracked product may be fed directly to the separation stage or, in the preferred embodiment, is fed via line 28 to a vacuum distillation or vacuum flash unit 30 which operates at the following conditions: pressure in the range 5–50 mm Hg and temperature between 550° to 700° F. so as to obtain a vacuum distillate recovered via line 32 and mixed with the light hydrocarbon stream 26 to form a synthetic crude which is free of any vacuum residual. The vacuum residual is then fed via line 34 to the separation stage 36 where the residual is mixed with a light hydrocarbon solvent from line 38. By mixing a light hydrocarbon solvent with the unconverted residual the viscosity of the residual is reduced thereby facilitating the separation of polynuclear hydrocarbons. The amount of the polynuclear hydrocarbon removed in the separation stage is dependent on the degree of incompatibility between the polynuclear hydrocarbons present in the unconverted residual and the light hydrocarbon solvent. By incompatibility again is meant that the hydroconverted product is unable to dissolve or disperse well the highly aromatic and condensed molecules, of large molecular weight, produced during the hydrocracking reactions. The degree of condensation is measured by NMR (Nuclear Magnetic Resonance) as well as the aromaticity which is the ratio of the number of aromatic carbons to total carbons. The high temperatures used in the hydrocracking reactor (approximately 450°–480° C.) give rise to an intense free radical formation, which tend to polymerize. These high molecular polynuclear hydrocarbons tend to segregate from the hydroconverted product, this precipitation or incompatibility depending on many factors such as aromatic content and degree of condensation, aromatic content of the hydroconverted product and of the added diluent or solvent, temperature, solvent to hydroconverted residue ratio, etc. It has been found that an increase in incompatibility and correspondingly an increase in polynuclear hydrocarbon separation is obtained when going from kerosene (12% wt. aromatics) having boiling range of 190°–330° C. to naphthas having boiling point ranges in the order of 50° C. to 190° C. to mixtures of pure components such as butanes, pentanes, hexanes, heptanes and octanes. The other parameter which controls the separation efficiency of polynuclear hydrocarbons is the ratio of solvent to unconverted residual; this ratio should be in the range of about 0.5/1 to 10/1, preferably between about 1/1 to 6/1 by volume.

This is no limitation as to the type of separation equipment which can be used in the separation stage of the present invention; however, the preferred equipment is a centrifugal decanter.

The clean upgraded hydrocracked residual coming from the separation stage is fed via lines 46 and 48 to a coker heater 62 where the clean hydrocracked residual is heated to a desired temperature of about 920° F. The clean hydrocracked residual is heated as it passes through coker heater 62 and is fed via line 64 to one of several delayed coking drums, either coke drum 66 or coke drum 68 where the hydrocracked residual decomposes leaving a mass of green coke which is of anode grade specifications. After sufficient coke is deposited in one coke drum, for example, coke drum 66, the flow from the coker heater 62 is switched to the other coke drum 68 which has been preheated. The coke in coke drum 68 is then removed. The coke bed in the full drum is steamed, stripped and then cooled by water quenching. The coke is then removed by hydraulic cutting and collected in a coke pit. The empty drum is then reheated, steam purged and pressure tested. It is then reheated in superheated steam to about 70° F. and ready to receive the hydrocracked residual from the coker heater 62.

In accordance with the specific feature of the process of the present invention a portion of the hydrocracked residual may be recycled from line 46 via line 50 where it may be mixed with virgin feed in line 10 prior to delivery to the preheater 12.

The advantages of the present invention will be made clear from the following examples.

EXAMPLE 1

A vacuum resid 950° F.+ of Zuata, a Venezuelan crude from the Orinoco Oil Belt, was fed to a hydroconversion reactor of the slurry type. The chemical and physical properties of the vacuum resid 950° F.+ are set forth below in Table I.

TABLE I

| CHARACTERISTICS OF FEED TO THE HYDROCONVERSION STAGE | |
|---|---|
| PROPERTIES | FEED |
| API | 3 |
| Sulfur (% wt) | 4.6 |
| Asphaltenes (% wt) | 21.5 |
| Conradson Carbon | 26 |
| Viscosity at 60° F. (cst) | — |
| Nitrogen (ppm) | 9500 |
| Vanadium (ppm) | 794 |
| Iron in Feed (from catalyst) (% wt) | 2.0 |

The feed was hydroconverted in a reactor of the slurry type under the following conditions: pressure 1900 psig, temperature 448° C., LHSV 0.5 $hr^{-1}$, catalyst limonite ($dp < 10\ \mu m$), catalyst concentration in feed 3%wt. The efficiency of the hydroconversion was measured by measuring the parameters set forth in Table II.

TABLE II

| EFFICIENCY OF HYDROCONVERSION | |
|---|---|
| Resid 950° F.+ conversion = | 90% |
| Asphaltenes conversion = | 92% |
| Conradson Carbon conversion = | 88% |
| Vanadium removal = | 98.7% |
| Sulfur removal = | 74% |
| Nitrogen removal = | 34% |

The characteristics of the hydroconversion product are shown below in Table III.

TABLE III

| CHARACTERISTICS OF PRODUCT FROM HYDROCONVERSION STAGE | |
|---|---|
| PROPERTIES | PRODUCT |
| API | 25 |
| Sulfur (% wt) | 1.2 |
| Asphaltenes (% wt) | 1.7 |

TABLE III-continued

| CHARACTERISTICS OF PRODUCT FROM HYDROCONVERSION STAGE | |
|---|---|
| PROPERTIES | PRODUCT |
| Conradson Carbon | 3.2 |
| Viscosity at 60° F. (cst) | 3.5 |
| Nitrogen (ppm) | 6300 |
| Vanadium (ppm) | 10 |
| Iron (from catalyst) (% wt) | 2.2 |

As can be seen from Table III the level of vanadium was reduced from 794 ppm down to 10 ppm in the hydroconversion product. The hydroconversion product was thereafter fed to a hot separator so as to obtain a light hydrocarbon stream and a residual hydrocracked product which was fed to a vacuum flash unit wherein a vacuum distillate was recovered and a vacuum resid produced. The characteristics of the unconverted vacuum residual 950° F.+ prior to feeding same to the separation stage is shown below in Table IV.

TABLE IV

| CHARACTERISTICS OF UNCONVERTED VACUUM RESID 950° F.+ FEED TO THE SEPARATION STAGE | |
|---|---|
| API | −3 |
| Conradson Carbon (% wt) | 30 |
| Asphaltenes (% wt) | 28 |
| Sulfur (% wt) | 2.3 |
| V (ppm) | 150 |
| Iron (from catalyst) (% wt) | 33.0 |

The unconverted vacuum resid was fed to a separator wherein it was mixed with a kerosene cut containing 80% paraffins in a solvent/resid ratio of 3:1 volume to volume. The characteristics of the vacuum resid product from the separation stage are set forth below in Table V.

TABLE V

| CHARACTERISTICS OF THE VACUUM RESID PRODUCT FROM THE SEPARATION STAGE | |
|---|---|
| API | 2 |
| Conradson Carbon (% wt) | 28 |
| Asphaltenes (% wt) | 22 |
| Sulfur (% wt) | 2.3 |
| Ash (% wt) | 0.03 |
| Fe (ppm) | 50 |
| Ni (ppm) | 30 |
| V (ppm) | 40 |

As can be seen, the vanadium level was reduced from 150 ppm to 40 ppm and iron was reduced still much more from 33%wt to 50 ppm. The product from the separation stage was fed to a coking unit wherein the feedstock was coked in a conventional manner. The characteristics of the resulting coke product are set forth below in Table VI.

TABLE VI

| CHARACTERISTICS OF COKE PRODUCED BY THE PROCESS OF THE PRESENT INVENTION | |
|---|---|
| Yield (% p) | |
| Coke | 53 |
| Distillates | 34 |
| Gas | 13 |
| Green Coke Characteristics | |
| Volatile Matter (% wt) | 7.3 |
| Ash (% wt) | 0.05 |
| Metals (ppm) | |
| Fe | 110 |
| V | 30 |

TABLE VI-continued

| CHARACTERISTICS OF COKE PRODUCED BY THE PROCESS OF THE PRESENT INVENTION | |
|---|---|
| Ni | 40 |
| Sulphur (% wt) | 2.1 |

As can be seen, the coke product produced by the process of the present invention meets the specifications of anode grade calcined coke.

EXAMPLE 2

The feed from Example I, namely the vacuum resid 950° F.+ Zuata, was fed directly to a coking unit without the process of the present invention. This procedure corresponds to conventional delayed coking processes where the only stages previous to the delayed coker unit are atmospheric and vacuum distillations. Table VII below indicates that under such a scheme both the metals (2000 ppm vanadium) and sulfur (4.4 wt.%) are far above the anode grade coke specifications. Comparison of the product obtained by the process of the present invention with the commercial coking process clearly demonstrates the benefits of the process of the present invention.

TABLE VII

| COKE PRODUCT FROM COMMERCIAL PROCESSING | |
|---|---|
| Yield (% p) | |
| Coke | 33.8 |
| Distillates | 55.8 |
| Gas | 10.4 |
| Green Coke Characteristics | |
| Volatile Matter (% wt) | 7.7 |
| Ash (% wt) | 0.5 |
| Metals (ppm) | |
| Fe | — |
| V | 2000 |
| Ni | 420 |
| Sulphur (% wt) | 4.4 |

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for the production of anode grade coke from a hydrocarbon feed characterized by high levels of sulfur and metals comprising feeding a hydrocarbon feed to a hydrocracking reactor; hydrocracking said hydrocarbon feed in said reactor under the following conditions: pressure about between 1000 to 4000 psi, LHSV of about between 0.2 to 3.0 $HR^{-1}$, hydrogen-crude ratio of about between 3,000 to 40,000 SCF/B and temperature of about between 420° to 500° C. wherein an effluent overhead is produced; feeding said effluent to a hot separator; treating said effluent in said hot separator wherein a light hydrocarbon stream and a slurry hydrocracked product residual are produced; feeding said slurry hydrocracked product residual to a separator; mixing a solvent with said hydrocracked residual in said separator; separating out the solids from said hydrocracked solvent rich residual so as to produce a clean upgraded hydrocracked solvent rich residual with low sulfur and metals content; and feeding said upgraded hydrocracked residual to a coking drum wherein said residual decomposes leaving a mass of anode grade coke.

2. A process according to claim 1 including mixing a catalyst with said hydrocarbon feed prior to feeding said hydrocarbon feed to said hydrocracking reactor.

3. A process according to claim 2 wherein said catalyst is selected from the group consisting of laterite, limonite, bauxite, clay, siderite and mixtures thereof.

4. A process according to claim 1 wherein said solvent is selected from the group consisting of naphthas, kerosene, butanes, pentanes, hexanes, heptanes, octanes and mixtures thereof.

5. A process according to claim 4 wherein said solvent is mixed with said hydrocracked residual in a ratio of about 0.5/1 to 10/1 by volume.

6. A process according to claim 1 wherein said hydrocarbon feed is characterized by a metals content of greater than 200 ppm per element and a sulfur content in excess of 3 wt.%.

7. A process according to claim 6 wherein said anode grade coke has the following composition and properties: for each metal less than 200 ppm, sulfur 0.4–3 wt.%, ash 0.1–4 wt.%., bulk density 82–92 G/100 CC, apparent density 1.65–1.78 G/CC, real density 2.04–2.07 G/CC, electrical resistivity 0.034–0.042 OHM-INCH and porosity 100–240 MM3/G.

8. A process according to claim 1 including the steps of recycling only said upgraded hydrocracked solvent rich residual to said hydrocracking reactor for further treatment.

* * * * *